US009930759B2

(12) United States Patent
Harrison

(10) Patent No.: US 9,930,759 B2
(45) Date of Patent: Mar. 27, 2018

(54) LIFE-LIGHT

(71) Applicant: Johnathan Harrison, Spring Hill, TN (US)

(72) Inventor: Johnathan Harrison, Spring Hill, TN (US)

( * ) Notice: Subject to any disclaimer, the term of this patent is extended or adjusted under 35 U.S.C. 154(b) by 216 days.

(21) Appl. No.: 14/960,771

(22) Filed: Dec. 7, 2015

(65) Prior Publication Data

US 2017/0164454 A1 Jun. 8, 2017

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 33/0857* (2013.01); *H05B 37/0281* (2013.01)

(58) Field of Classification Search
CPC ..... H05B 7/02; H05B 33/08; H05B 37/0272; H05B 37/0281; H05B 33/0845; H05B 33/0857; G08B 21/0269; G08B 21/0277; H04W 4/22
USPC ..... 315/86, 87, 185 R, 129, 291, 307, 308, 315/312
See application file for complete search history.

(56) References Cited

U.S. PATENT DOCUMENTS 8,538,374 B1 * 9/2013 Haimo ..... G01S 19/17 370/259
2005/0119016 A1 * 6/2005 Neumann ..... H04W 76/02 455/466

* cited by examiner

*Primary Examiner* — Jimmy Vu
(74) *Attorney, Agent, or Firm* — Waller Lansden Dortch & Davis, LLP; Blake M. Bernard

(57) ABSTRACT

An emergency light system is provided to help an emergency response team in locating an emergency site, the emergency light system comprising an LED light bulb with a wireless connectivity preferably Wi-Fi, and an app installed on a mobile communication device and connected to the LED light bulb via the wireless connectivity. The app allows registering emergency numbers in it. Further, the app is connected to the dialing pad of the mobile communication device to detect dialing of a registered emergency number. When the app detects the dialing of a registered emergency number, it sends signal to the LED light bulb via wireless connection to activate the LED light bulb to light in strobe pattern. The LED light bulb can be deactivated automatically after 45 minutes or manually through App. The emergency light system also provides a battery backup to the LED light bulb.

13 Claims, 2 Drawing Sheets

LIFE-LIGHT

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of Invention

The present invention generally relates to an emergency light system. More particularly, the present invention relates to "an emergency light system to help emergency response team in locating an emergency site with the help of a light signal on the emergency site activated by app".

(2) Background of Invention

When people face an emergency situation such as fire, critical health condition like a heart attack, assault on the people present in a home etc., they contact the emergency response teams such as fire department, hospital, emergency medical services (EMS), police etc. on emergency numbers. Many states in the United States of America use centralized emergency response telephone services such as 911 which when dialed, a dispatch personnel hearing the call gathers the necessary information including the address of the home associated with the emergency condition. The dispatch personnel will then contact the concerned department for handling the emergency for example, fire department to control the fire spreading in a premise. It is difficult for an emergency response team to locate the exact location of the emergency with the provided address and hence they may proceed at a deliberate slow pace to locate the exact address.

This results in excessive time loss in finding the location of the emergency. Loss of time is a major issue in the case of an emergency as it may result in loss of lives and valuable assets. Sometimes loss of time even in seconds is critical and saving this time can make a big impact on the situation. The problem is even bigger if the emergency site is not adequately marked with an address or is located in site of multiple apartments or buildings.

Hence there has been an attempt to provide methods to help the emergency response team in locating the exact address. For example, U.S. Pat. No. 5,880,672 A issued to Edward Weaver on 1999, Mar. 9, discloses an emergency indicator system comprising a visual display unit which is activated when a person dials 911 using a telephone located within a building during an emergency, to allow emergency rescue vehicle, the police etc. in quickly locating the building. Similarly, U.S. Pat. No. 8,350,479 B1 issued to Brazille Ii Austin T on 2013, Jan. 8, discloses an emergency light bulb mounted on housing, a control unit connected to the emergency light bulb and a receiver, a transmitter for sending a wireless signal to the receiver which activated the control unit to turn on the emergency light bulb to attract attention of a passerby. Also, U.S. Pat. No. 8,666,029 B2 issued to Valerie Binning on 2014, Mar. 4, discloses a method to locate a communication device at an emergency site with the help of a position locating means such as a transmission signal or a homing signal or a Global Positioning System associated to a room location sent to a networked device to be communicated to emergency response personnel. However, these methods and devices are complicated to use and need improvement for supporting the use of currently available mobile communication devices. Hence, it is desired that a method or system is provided which supports latest technology mobile communication devices and efficiently helps emergency response team in locating an emergency site quickly and easily. Further, it is desired that the method or system is easy to use.

It is an aspect of the invention to overcome or alleviate a problem of the prior art.

This permits the use of the present invention which enhance the prior art of the method for helping an emergency response team in efficiently and quickly locating an emergency site.

BRIEF SUMMARY OF THE INVENTION

In view of the foregoing, one aspect of the various disclosed embodiments in the present invention is to provide an emergency light system to help emergency response team in locating an emergency site with the help of a light signal on the emergency site activated by an app.

Preferably the emergency light system addresses, or at least ameliorates, one or more of the problems described above. To this end, the present invention related to an emergency light system, with some unique aspects is disclosed.

Accordingly, it is a primary object of the present invention to provide an emergency light system to help emergency response team in locating an emergency site with the help of a light signal on the emergency site activated by an app. The light signal is generated by an LED light bulb having a wireless connectivity. The app is installed on a mobile communication device. The app in response to dialing of an emergency number from the mobile communication device, activates the LED light bulb to generate the light signal in the form of a strobe pattern.

It is yet another object of the present invention that the strobe pattern generated by LED light bulb is easily recognizable by the emergency response team.

It is yet another object of the present invention that the app is provided for various types of operating system including Android and iPhone operating system.

It is yet another object of the present invention that the app allows registering multiple emergency numbers and can detect dialing of any of the multiple registered numbers.

It is yet another object of the present invention that the activated LED light bulb can be automatically deactivated after a predetermined time.

It is yet another object of the present invention that the activated LED light bulb can be deactivated manually using the app.

It is yet another object of the present invention that the emergency light system provides a battery backup to power the LED light bulb, thereby allowing positioning the LED light bulb at any desired place to be easily visible to coming emergency response team.

It is still another object of the present invention that the activated LED light bulb can be deactivated to act as a normal porch light.

Other objects of the present invention will become apparent from time to time throughout the specification as hereinafter related.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE SEVERAL VIEWS OF THE DRAWINGS

To further clarify various aspects of some example embodiments of the present invention, a more particular description of the invention will be rendered by reference to specific embodiments thereof, which are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

DETAILED DESCRIPTION OF THE INVENTION

The following detailed description of the present invention is enabling teaching of the invention and its best, currently known embodiment. Those skilled in the art can understand that many changes can be made in the embodiments described, while still obtaining beneficial results of the present invention. It will also be apparent that some of the desired benefits of the present invention can be obtained by selecting some of the features of the invention while not utilizing other features. Accordingly, those working in the relevant art will recognize that many adaptations and modification to the present invention can be made and may be desired in certain circumstances, and are part of the present invention. Thus, the following description is provided as illustrative of the principle of the present invention.

Figure 1:
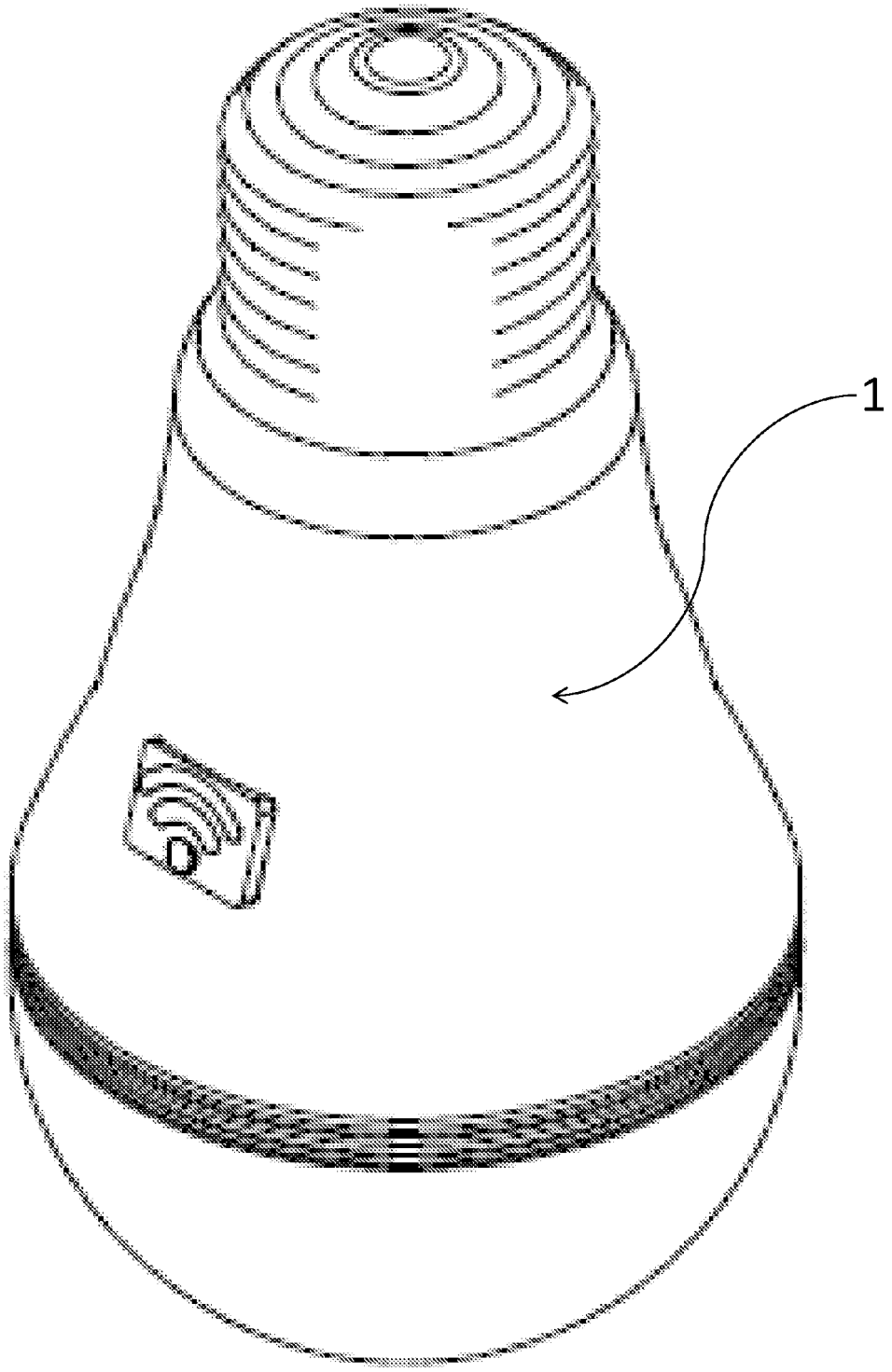
FIG. 1 illustrates a perspective view of LED light bulb in disarmed mode functioning as a normal porch light.

Referring to the figures, specifically to FIG. 1 thereof, is shown a light bulb 1 of emergency light system. The emergency light system comprises of an LED light bulb 1 with built in wireless connectivity and a corresponding app installed on a mobile communication device like a smart phone 2.

Figure 2:
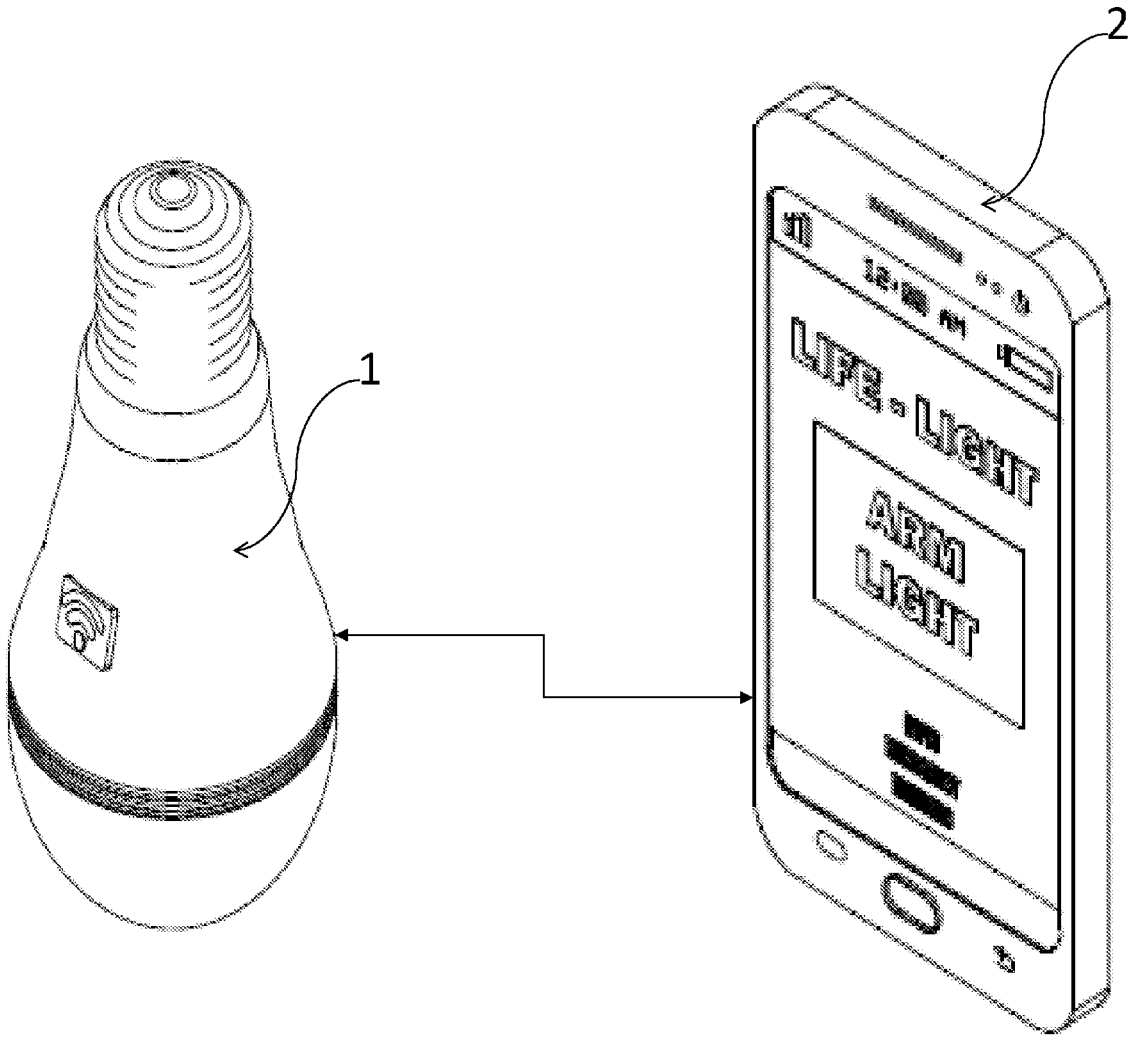
FIG. 2 illustrates a perspective view of LED light bulb in armed mode in response to emergency number dialed on the mobile communication device.

Referring to the figures, specifically to FIG. 2 thereof, is shown an exemplary application of emergency light system in case of emergency, the user calls 911 using a smart phone 2 having the app installed in it with 911 entered in the app as a registered emergency number, the app recognizes the dialed number as a registered emergency number and sends signal to the LED light bulb 1 via WiFi. The LED light bulb 1 on receiving the signal changes from normal clear light pattern.

Embodiments of the present invention provide an emergency light system to help emergency response team in locating an emergency site with the help of a light signal on the emergency site activated by an app. The app is installed on a mobile communication device used for making an emergency call. Accordingly, the specific embodiments discussed herein are merely illustrative of specific manners in which to make and use this invention, and are not intended to represent an exhaustive list of all possible structure and processes of the present invention.

Embodiments of the method are shown in the figures, and discussed below. While the structure and processes have been described with a certain degree of particularity, it is to be noted that many modifications may be made in the details of the structure and processes without departing from the spirit and scope of this disclosure. It is understood that the structure and processes are not limited to the embodiments set forth herein for purposes of exemplification.

Aspects of the present inventive subject matter are described with reference to the figures provided herein.

The present invention provides an emergency light system for helping emergency response team such as fire department team, emergency medical services, police etc. to locate an emergency caller quickly and easily. The emergency light system comprises of an LED light bulb 1 with built in wireless connectivity and a corresponding app installed on a mobile communication device, the app controls the function of the LED light bulb 1 via the wireless connection. It is preferred that the wireless connectivity feature integrated in the LED light bulb 1 is WiFi. The WiFi integrated in the LED light bulb 1 allows the app installed in the mobile communication device to communicate with the LED light bulb 1. The LED light bulb 1 produces light when supplied with power from a power source. The app is set up for controlling the color presentation, color pattern and intensity of the light produced by the LED light bulb 1. The color of the light produced by the LED light bulb 1 of the present invention is set by the app as a default to a strobe or "pulsating" pattern changing colors from RED to BLUE to AMBER to CLEAR light. It is preferred that the strobe or "pulsating" pattern of the color of armed LED light bulb 1 is non-customizable. The app provides the option to activate or "Arm" the LED light bulb 1 once an emergency y number is detected by the dial pad. On changing to activated state, the LED light bulb 1 generated the strobe pattern light. The activated LED light bulb 1 may automatically change to deactivated state after a predetermined time. It is preferred that the strobe pattern is repeated on a 45 minute timer. At the end of the 45 minutes, the LED light is automatically changed to deactivated state or disarmed to revert to a usable porch light with a clear light. The LED light bulb 1 can also be manually deactivated or disarmed by selecting "Disarm" option in the app.

When the app is first downloaded and installed on a mobile communication device, the app is registered. In the registration process in the app, the user will enter basic information, such as their name and email address as well as their physical street address where the LED light bulb 1 will be used. The next step will be to enter the emergency numbers applicable in that area. Most areas in the United States of America have the enhanced 9-1-1 system which will be one operator that can provide any emergency service needed. Some rural areas that do not use enhanced 9-1-1 still use standard 7 digit (10 with area code) numbers for police, fire or emergency medical. Hence, the user will enter in the app all emergency numbers applicable in the area in which the user is located and these emergency numbers would require an emergency responder to respond to that residence when called. The app is integrated with the dial pad of the mobile communication device. The mobile communication device includes, but not limited to a smart phone 2, tablet, laptop and desktop computer.

After the app is set up on the mobile communication device, if the user dials one of the emergency numbers registered in the app using the dial pad in the correct order, the app recognizes the number being dialed and in response arms the LED light bulb 1. On being armed, the LED light bulb 1 immediately begins to strobe in the four color pattern. Hence, in the emergency light system of the present invention, the LED light bulb 1 stays in two states, 'armed' state to produce light in "pulsating" pattern and in 'disarmed' state to produce clear light.

In a preferred embodiment of the present invention, the emergency light system, provides a battery backup in the LED light bulb 1 that powers the LED Light bulb 1 during the day when the porch light is not turned on and during power outages. Further, it allows positioning the LED light bulb 1 at any desired place to be easily visible to the coming emergency response team. The LED light bulb 1 with the battery backup will be able to position at various locations without the need of a light socket. The app for controlling the operation of the LED light bulb 1 is provided for different types of operating systems including android and iPhone operating systems.

The significance of the colors during the strobe or "pulsating" pattern of the LED light bulb 1 of the present invention are the colors of responding emergency personnel. RED is a light signal usually used by the Fire/emergency medical services (EMS) team, BLUE is a light signal usually used by the police, AMBER is a light signal usually used by Rescue/EMS/Fire team, while CLEAR light is a light signal for all responders. When a user dials his/her emergency number that is registered with the LED light app, the user will be speaking with an operator or emergency personnel directly and the user can inform the operator about the light bulb 1 generating strobe pattern light on the user's porch or other suitable location. Also, through basic marketing and advertising in the emergency services, the recognizing of the bulb 1 will be simple. Additionally, it is a common understanding for emergency responders to recognize a flashing strobe of multiple colors as a possible location of the emergency.

The emergency light system of the present invention can be very easily be integrated with and used concurrently with commercial and residential security systems. The emergency light system of the present invention would add a great feature to the security systems business.

It is to be understood that the above description is intended to be illustrative, and not restrictive. For example, the above discussed embodiments may be used in combination with each other. Many other embodiments will be apparent to those of skill in the art upon reviewing the above description.

Whereas, the structure and processes have been described in relation to the figures of the drawings, it should be understood that other and further modifications, apart from those shown or suggested herein, may be made within the spirit and scope of this invention.

I claim:

1. An emergency light system for helping an emergency response team in locating an emergency site, the emergency light system comprising:

an LED light bulb having a wireless connectivity, said LED light bulb configured to produce strobe pattern light in an activated state and produce clear light in deactivated state, said LED light bulb visible from outside of said emergency site;

an app for changing said LED light bulb to activated state and deactivated state, said app allowing registration of emergency number, said app downloaded and installed on a mobile communication device, said app connected to dialing pad of said mobile communication device to detect said registered emergency number if dialed on the dialing pad, said app on detecting dialing of said registered emergency number send signal to the LED light bulb via wireless connectivity to activate said LED light bulb.

2. The emergency light system of claim 1, wherein said app controls color presentation, color pattern and intensity of the light produced by said LED light bulb.

3. The emergency light system of claim 1, wherein said wireless connectivity is WiFi.

4. The emergency light system of claim 1, wherein said app allows registration of multiple emergency number.

5. The emergency light system of claim 1, wherein said app allows registration of 911 as an emergency number.

6. The emergency light system of claim 1, wherein said app operates on the android operating system.

7. The emergency light system of claim 1, wherein said app operates on the iPhone operating system.

8. The emergency light system of claim 1, wherein said strobe pattern light changes colors from red to blue to amber to clear light.

9. The emergency light system of claim 1, wherein said activated LED light bulb automatically changes to deactivated state after a predetermined time.

10. The emergency light system of claim 1, wherein said activated LED light bulb automatically changes to deactivated state after 45 minutes.

11. The emergency light system of claim 1, wherein the emergency light system further includes a battery backup to power said LED light bulb.

12. The emergency light system of claim 1, wherein said mobile communication device is a smart phone.

13. The emergency light system of claim 1, wherein said mobile communication device is a tablet, laptop or desktop computer.

* * * * *